US008696326B2

(12) United States Patent
Hadar et al.

(10) Patent No.: US 8,696,326 B2
(45) Date of Patent: Apr. 15, 2014

(54) INTEGRATED ELECTRICAL AUXILIARY OIL PUMP

(75) Inventors: Gil Hadar, Guelph (CA); Andy Bennett, Oakville (CA); Liping Wang, Richmond Hill (CA)

(73) Assignee: Magna Powertrain Inc., Concord (CA)

( * ) Notice: Subject to any disclaimer, the term of this patent is extended or adjusted under 35 U.S.C. 154(b) by 354 days.

(21) Appl. No.: 12/612,901

(22) Filed: Nov. 5, 2009

(65) Prior Publication Data

US 2010/0290934 A1 Nov. 18, 2010

Related U.S. Application Data

(60) Provisional application No. 61/178,333, filed on May 14, 2009.

(51) Int. Cl.
*F04B 35/04* (2006.01)

(52) U.S. Cl.
USPC ..... 417/363; 417/310; 417/410.1; 417/410.3

(58) Field of Classification Search
USPC ..... 417/310, 363, 410.3, 410, 420; 418/61.3
See application file for complete search history.

(56) References Cited

U.S. PATENT DOCUMENTS

| | | | | |
|---|---|---|---|---|
| 4,519,755 | A | | 5/1985 | Hanson |
| 5,145,348 | A | | 9/1992 | Zumbusch |
| 5,217,085 | A | | 6/1993 | Barrie et al. |
| 5,336,064 | A | | 8/1994 | Lamers |
| 5,360,322 | A | * | 11/1994 | Henein et al. ..... 417/313 |
| 5,702,242 | A | | 12/1997 | Nied-Menninger et al. |
| 5,743,231 | A | | 4/1998 | Reinosa |
| 5,807,090 | A | | 9/1998 | Agner |
| 5,975,868 | A | | 11/1999 | Agner |
| 6,120,270 | A | | 9/2000 | Parsch |
| 6,152,716 | A | | 11/2000 | Agner |
| 6,164,928 | A | | 12/2000 | Agner |
| 6,227,816 | B1 | | 5/2001 | Breuer et al. |
| 6,234,775 | B1 | | 5/2001 | Agner et al. |
| 6,244,830 | B1 | | 6/2001 | Agner |
| 6,349,692 | B1 | | 2/2002 | Reinosa |
| 6,413,063 | B1 | | 7/2002 | Parsch et al. |
| 6,485,277 | B2 | | 11/2002 | Agner et al. |
| 6,561,155 | B1 | | 5/2003 | Williams |
| 6,579,013 | B2 | | 6/2003 | Gaio et al. |
| 6,896,489 | B2 | | 5/2005 | Hunter et al. |
| 7,018,178 | B2 | | 3/2006 | Hunter et al. |
| 7,156,623 | B2 | * | 1/2007 | Sakakibara et al. ..... 417/310 |
| 7,314,352 | B2 | | 1/2008 | Nakayoshi et al. |
| 7,344,361 | B2 | | 3/2008 | Kiefer |
| 7,396,214 | B2 | | 7/2008 | Hunter et al. |
| 2005/0186089 | A1 | * | 8/2005 | Nakayoshi et al. ..... 417/355 |
| 2008/0038117 | A1 | | 2/2008 | Armenio et al. |
| 2008/0069704 | A1 | | 3/2008 | Armenio et al. |

* cited by examiner

*Primary Examiner* — Charles Freay
*Assistant Examiner* — Patrick Hamo
(74) *Attorney, Agent, or Firm* — Harness, Dickey & Pierce, P.L.C.

(57) ABSTRACT

An externally mounted electric fluid pump for pumping fluid within a power transmission device is disclosed. The pump includes a housing adapted to be mounted to an external surface of the power transmission device. The pump is positioned within the housing and includes an input member. An electric motor is positioned within the housing and drives the input member. A controller is positioned within the housing to control the electric motor and vary the output of the pump.

14 Claims, 14 Drawing Sheets

INTEGRATED ELECTRICAL AUXILIARY OIL PUMP

CROSS-REFERENCE TO RELATED APPLICATIONS

This application claims the benefit of U.S. Provisional Application No. 61/178,333, filed on May 14, 2009. The entire disclosure of the above application is incorporated herein by reference.

FIELD

The present disclosure generally relates to fluid pumps. More particularly, an integrated electric auxiliary oil pump for an automobile is described.

BACKGROUND

This section provides background information related to the present disclosure which is not necessarily prior art.

Many automatic transmissions, engines, transfer cases and other power transferring devices are equipped with internal oil pumps for lubrication or other pressurized fluid supply. Internal oil pumps are typically continuously driven by a rotating member of the vehicle powertrain. While this arrangement is fairly simple to construct, continuously driving the pump may not be the most efficient way of operating the vehicle. During certain modes of vehicle operation, the input shaft driving the pump may rotate at relatively high speed thereby producing relatively high fluid flow at a time when relatively low or no fluid flow is required. The energy to drive the pump during these modes of operation is not providing value and may be considered inefficient waste.

Additionally, many of the previously known pumps are sealed within cavities formed by the engine or transmission housings. Difficulty may arise when attempting to supply an electric signal to control an actuator of the pump due to the difficulty of connecting a wire harness within the enclosed environment. Accordingly, a need exists for an electric auxiliary oil pump.

SUMMARY

This section provides a general summary of the disclosure, and is not a comprehensive disclosure of its full scope or all of its features.

An externally mounted electric fluid pump for pumping fluid within a power transmission device is disclosed. The pump includes a housing adapted to be mounted to an external surface of the power transmission device. The pump is positioned within the housing and includes an input member. An electric motor is positioned within the housing and drives the input member. A controller is positioned within the housing to control the electric motor and vary the output of the pump.

The present disclosure also provides an externally mounted electric pump for pumping fluid within a power transmission device. The pump includes a first housing member adapted to be mounted to an external surface of the power transmission device with a first recess having a substantially planar first pump surface surrounded by a first wall. A second housing member is fixed to the first housing member with a second recess having a substantially planar second pump surface surrounded by a second wall as well as being spaced apart from and extending substantially parallel to the first pump surface. A gerotor pump includes an inner rotor and an outer rotor, each rotor having opposite faces positioned adjacent the first and second pump surfaces, the outer rotor being aligned on an axis of rotation by the first and second walls. A rotor shaft engages each of the first and second housing members and defines an inner rotor axis of rotation offset from the outer rotor axis of rotation. An electric motor stator is positioned with a pocket formed in one of the first and second housing members. A plurality of permanent magnets is fixed for rotation with the outer rotor, the magnets being positioned proximate the stator.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
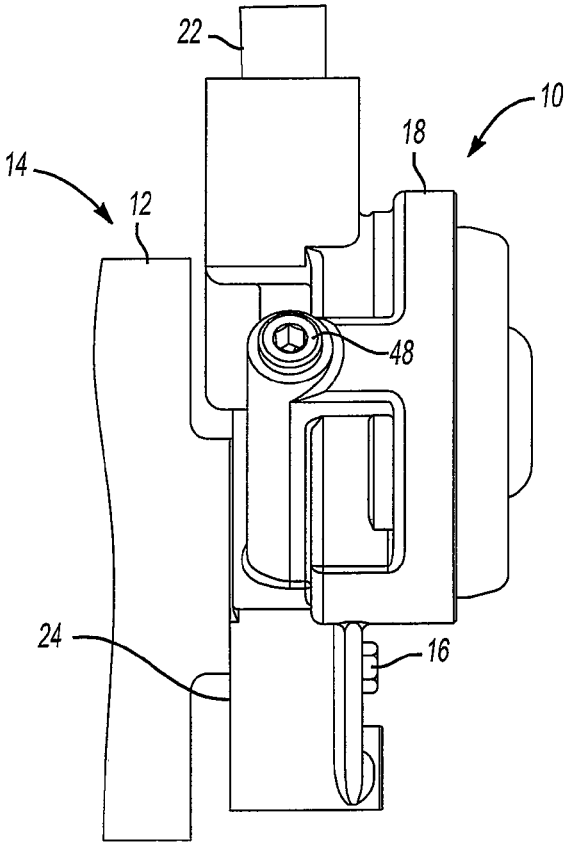
FIG. 1 is a side view of an auxiliary electric oil pump coupled to an exemplary transmission.
Figure 2:
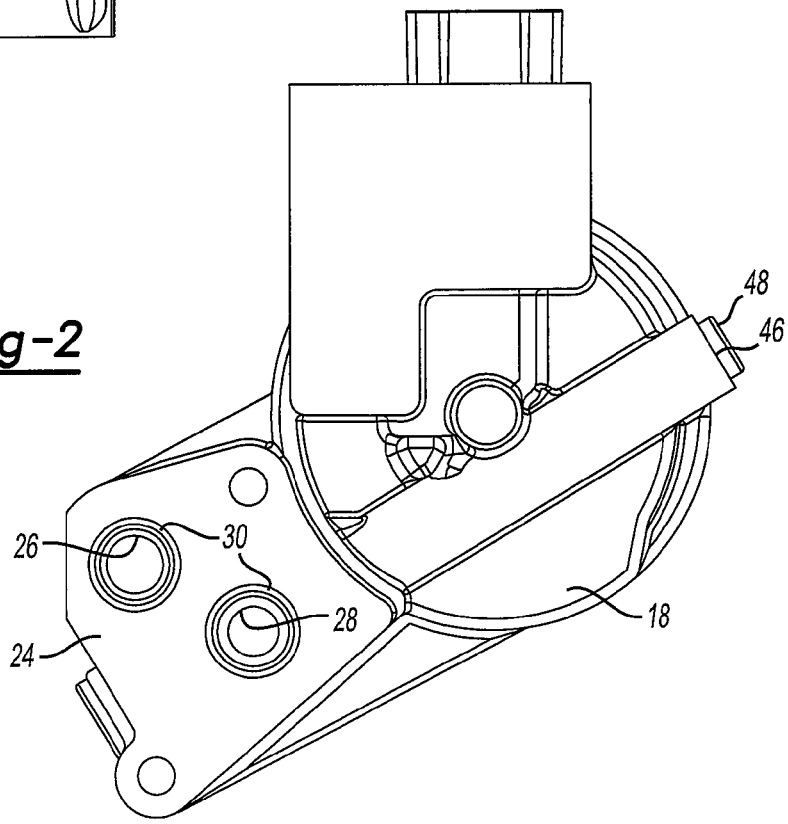
FIG. 2 is a back view of the auxiliary electric oil pump.
Figure 3:
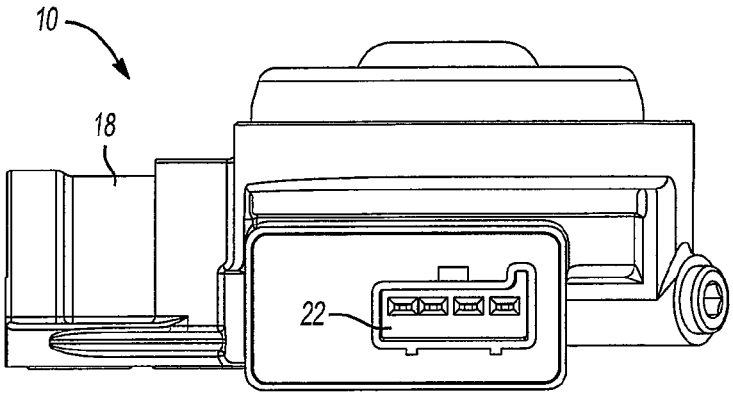
FIG. 3 is a top view of the auxiliary electric oil pump.
Figure 4:
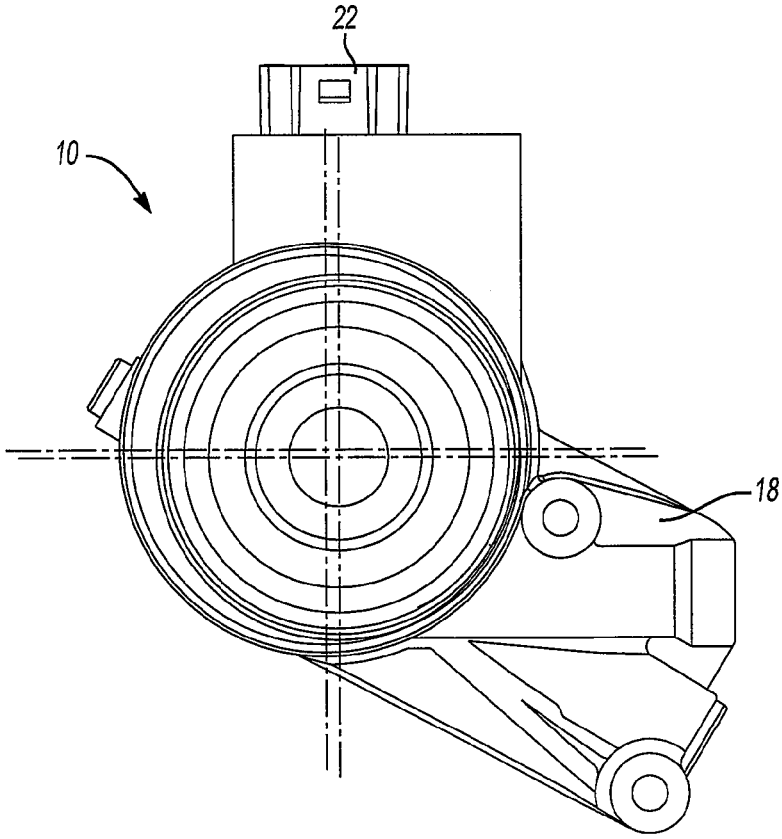
FIG. 4 is a front view of the auxiliary electric oil pump.
Figure 5:
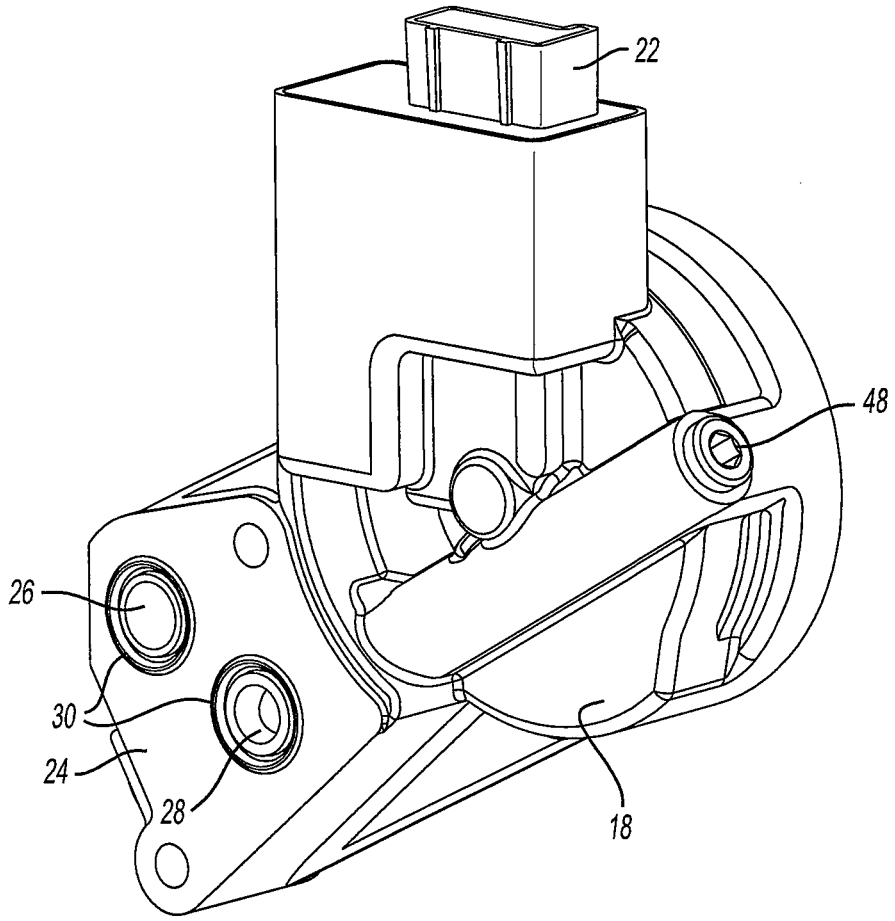
FIG. 5 is a perspective view of the auxiliary electric oil pump.
Figure 7:
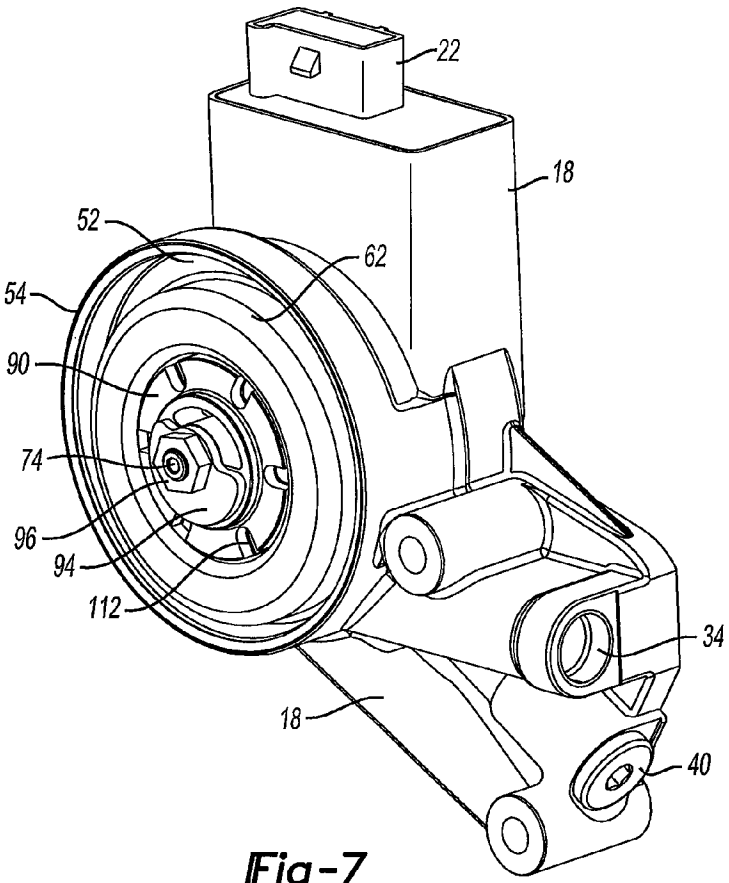
FIG. 7 is a perspective view of the auxiliary electric oil pump having a cover removed.
Figure 6:
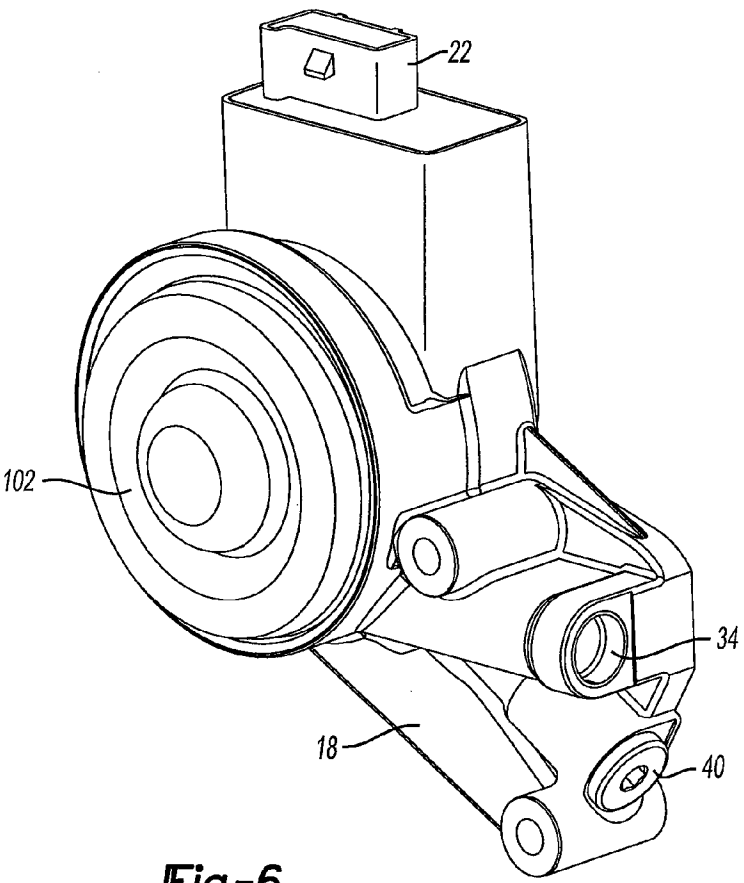
FIG. 6 is another perspective view of the auxiliary electric oil pump.
Figure 8:
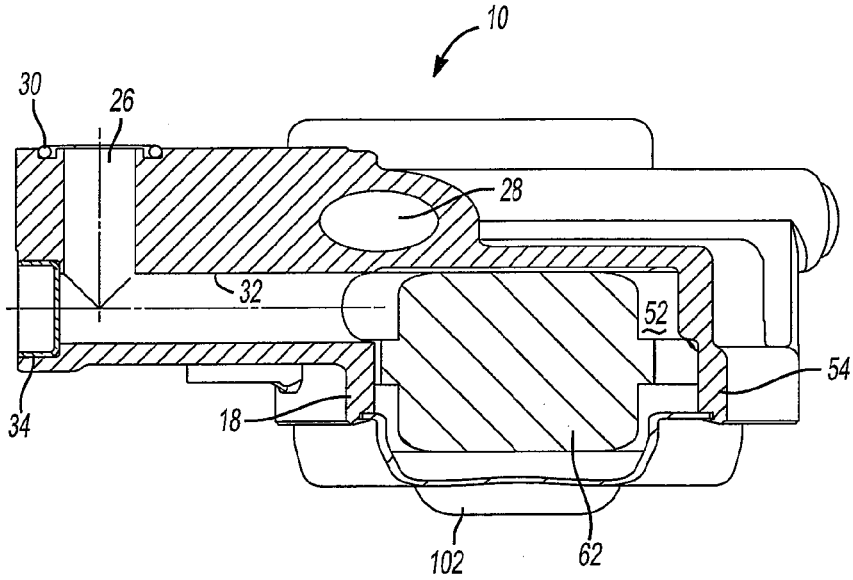
FIG. 8-11 are cross-sectional views of the auxiliary electric oil pump.
Figure 9:
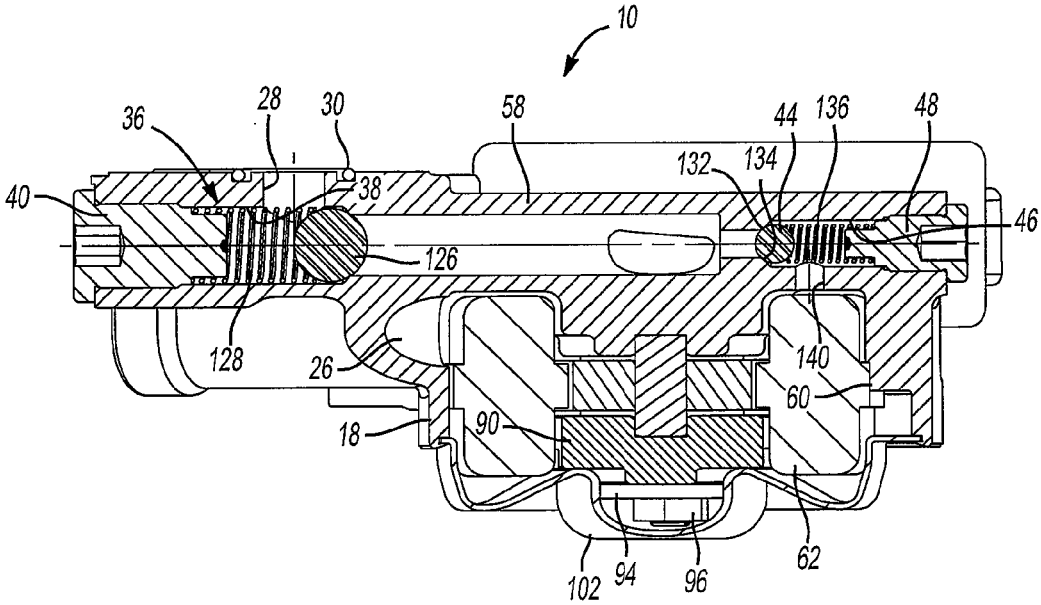
Figure 10:
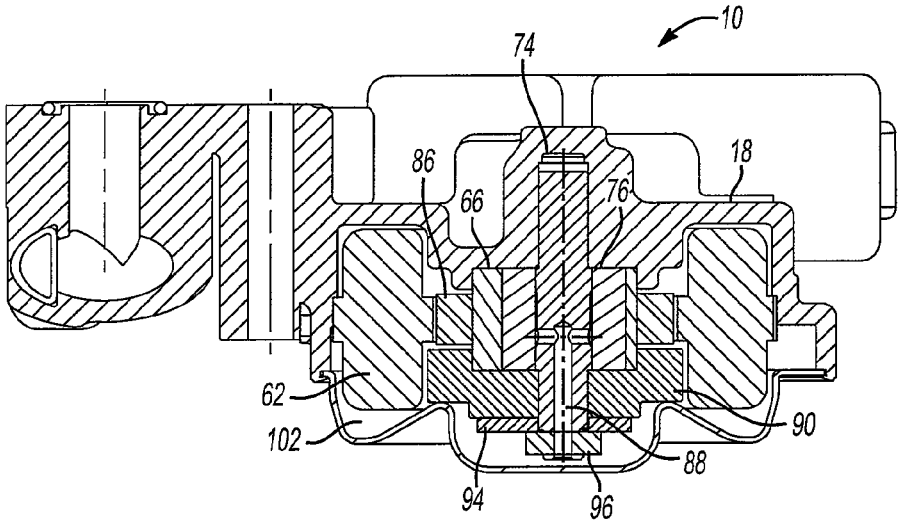
Figure 11:
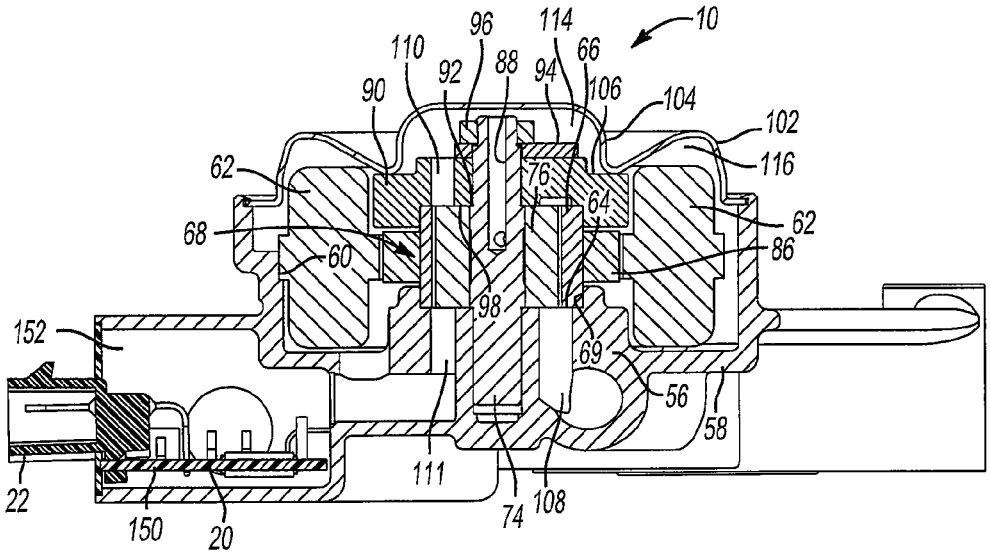
Figure 12:
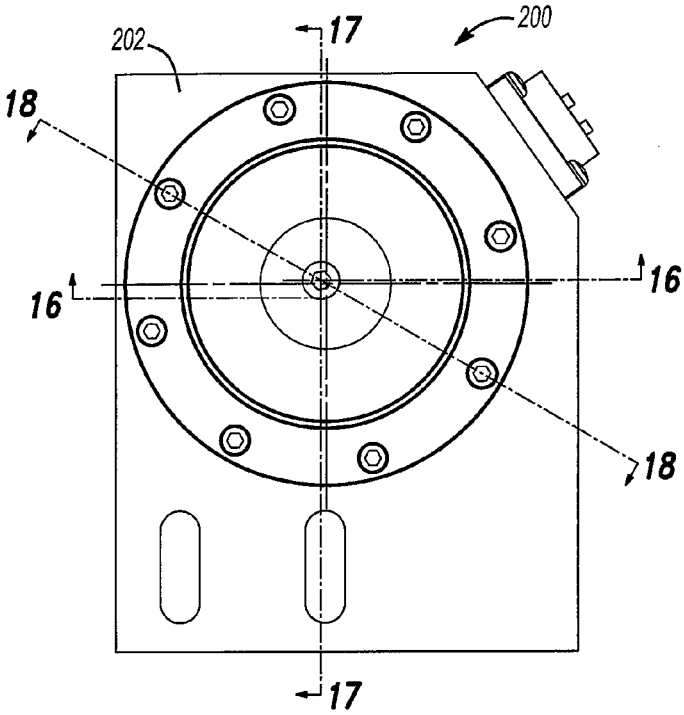
FIG. 12 is a top view of an alternate auxiliary electric oil pump.
Figure 13:
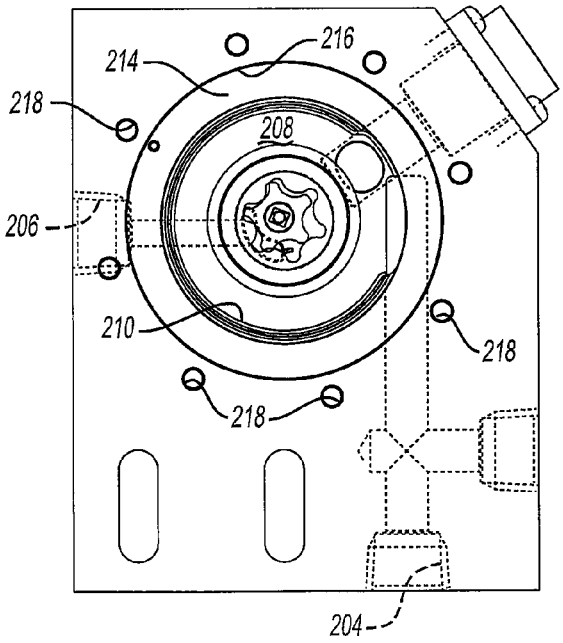
FIG. 13 is a top view of the pump of FIG. 12 having a cover removed.
Figure 14:
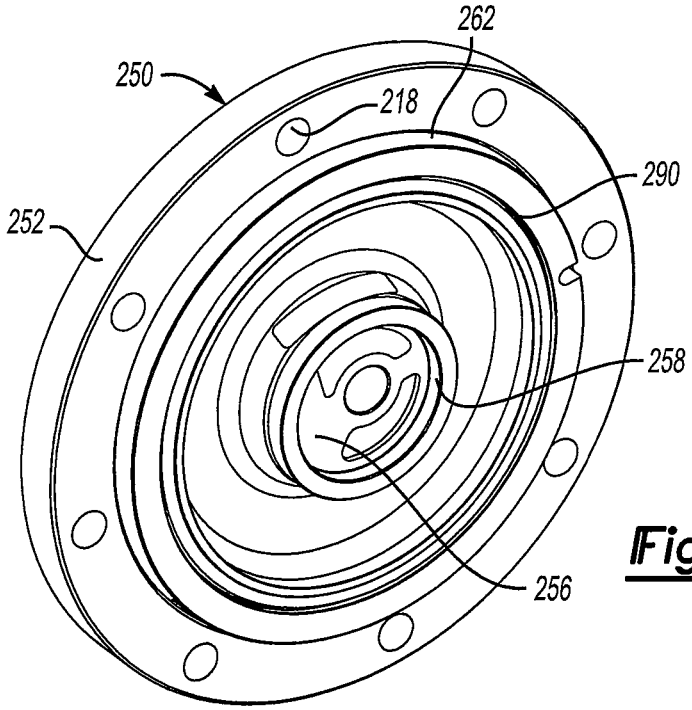
FIG. 14 is a perspective view of the pump cover.
Figure 15:
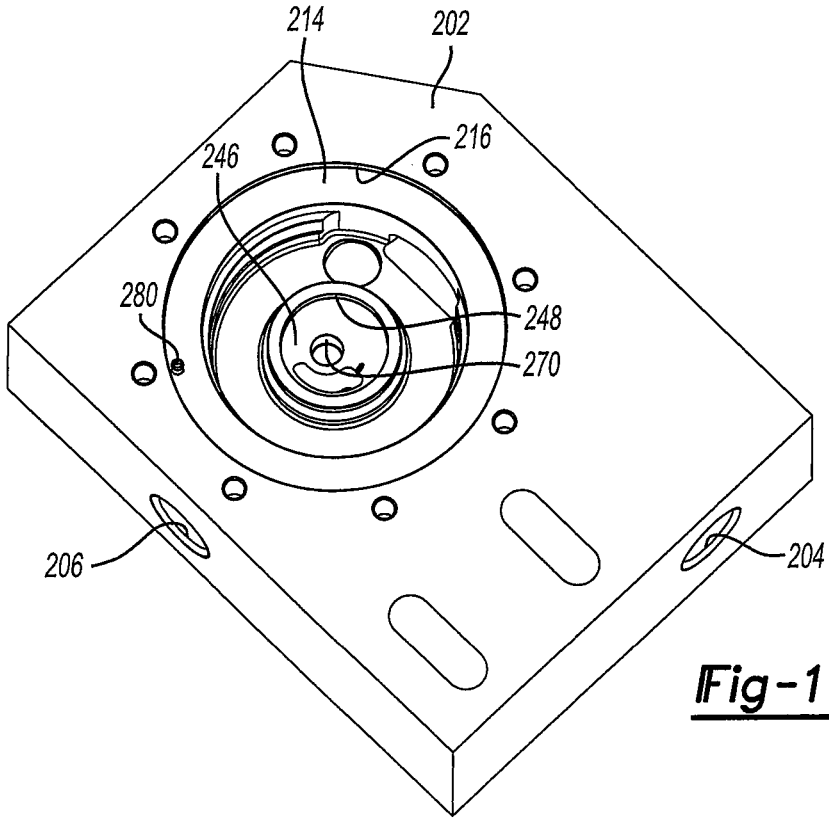
FIG. 15 is a perspective view of a pump housing.

With reference to FIG. 1, an integrated electric auxiliary oil pump 10 is fixed to a housing 12 of an exemplary transmission 14 by a plurality of externally accessible fasteners 16. Pump 10 includes a housing 18 enclosing each of the pump components as well as a controller 20 (FIG. 11). A controller connector 22 protrudes from housing 18 to allow electric power to be supplied to pump 10.

FIGS. 2-11 depict pump 10 in greater detail. In particular, housing 18 includes a mounting face 24 for engagement with an external surface of transmission housing 12. An inlet 26 and an outlet 28 are formed in housing 18 and are positioned to communicate with apertures extending through transmission housing 12. O-rings 30 seal the interface between transmission 14 and pump 10.

An inlet bore 32 is in fluid communication with inlet 26. An inlet plug 34 is provided to seal the passageway. A check valve 36 is positioned within a check valve bore 38 extending through housing 18. A check valve plug 40 seals check valve bore 38 from the atmosphere. A relief valve 44 is positioned within a relief valve bore 46. A relief valve plug 48 is fixed to housing 18 to close relief valve bore 46 off from the atmosphere.

Housing 18 also includes a cavity 52 defined by a substantially cylindrical wall 54. A boss 56 protrudes inwardly from an end wall 58 that intersects cylindrical wall 54. A cylindrical surface 60 of cylindrical wall 54 acts as a guide for a stator 62. An inner shoulder 64 of boss 56 provides an axial stop for an outer gear 66 of a gerotor pump assembly 68. A cylindrical bore 69 intersects shoulder 64 and serves to define an axis of rotation of outer gear 66.

A shaft 74 is pressed into pump housing 18. As an option, shaft 74 may be secured to housing 18 by a retaining ring or a fastener. Shaft 74 includes an external surface that defines an axis of rotation of an inner gear 76 that is parallel to and offset from the axis of rotation of outer gear 66. The eccentric arrangement between external lobes of inner gear 76 and lobes formed on outer gear 66 create the fixed displacement pumping action of gerotor pump assembly 68. Inner gear 76 is rotatably supported on shaft 74. A permanent magnet 86 is fixed to outer gear 66. Outer gear 66 and stator 62 are supported such that a small predetermined gap exists between permanent magnet 86 and an inner diameter of stator 62 to allow relative rotation thereto. An oil passage 88 extends through shaft 74 to allow fluid to lubricate the interface of inner gear 76 and shaft 74. Oil passage 88 interconnects a high pressure zone and a low pressure zone to assure flow occurs through this area.

A support plate 90 is clamped against a shoulder 92 formed on shaft 74. A support plate washer 94 and a nut 96 secure support plate 90 against shoulder 92. A predetermined gap exists between a face 98 of support plate 90 and side faces of inner gear 76 and outer gear 66. To provide additional support to support plate 90, a pump cover 102 includes a convoluted portion 104 placed in biased engagement with an upper surface 106 of support plate 90. An outer perimeter of cover 102 is fixed to housing 18 by a crimping operation. Other retention means may also be used to couple cover 102 to housing 18.

A high pressure port 108 communicates with outlet 28. Inlet 26 and inlet bore 32 supply both sides of gerotor pump assembly 68 with low pressure fluid. More particularly, a first inlet port 110 extends through support plate 90 to provide pressurized fluid to one side of gerotor pump assembly 68. A second inlet port 111 extends through housing 18 to provide low pressure fluid to the opposite side of gerotor pump assembly 68. A plurality of circumferentially spaced apart slots 112 are formed in support plate 90 to allow fluid flow between a first cavity 114 and a second cavity 116 defined by cover 102.

Check valve 36 includes a check valve ball 126 biased into engagement with housing 18 by a check valve spring 128. Check valve 36 functions to permit oil flow in only one direction and prevent the flow from reversing. Check valve plug 40 reacts the load provided by check valve spring 128.

Relief valve 44 includes a relief valve ball 132 biased into engagement with a seat 134 formed in housing 18 by a relief valve spring 136. Relief valve plug 48 reacts the load from relief valve spring 136. Relief valve 44 provides over-pressure protection to the components of pump 10. When an over-pressure condition occurs, relief valve ball 132 will overcome the load provided by relief valve spring 136 to allow highly pressurized fluid to pass through a gallery 140 that is in communication with the inlet to gerotor pump assembly 68.

Controller 20 includes a board 150 having electrical input provided from controller connector 22. The output from board 150 is coupled to stator 62 such that electrical current is provided through the windings of stator 62 to create an electromagnetic field. In the Figure, board 150 is positioned within a cavity 152 that does not contain pumped fluid. Board 150 is dry. Cavity 152 may be sealed through the use of a plug (not shown) allowing stator wires to pass therethrough. Board 150 may alternatively be encapsulated to keep it dry. Controller 20 may include an integrated circuit or integrated circuits operable to determine the current being provided to stator 62. Also, controller 20 may be operable to determine the torque applied to outer gear 66. In an alternate arrangement, board 150 may be exposed to the pumped fluid.

In operation, pump 10 receives current from an external source through controller connector 22. Energy is provided to controller 20 where a determination is made whether to provide current to stator 62. The magnitude of current to be provided to stator 62 is also determined. As the magnitude of current provided to stator 62 varies, the strength of an electromagnetic field surrounding stator 62 is also varied. The electromagnetic field interacts with permanent magnet 86 causing outer gear 66 to rotate. Because outer gear 66 is in meshed engagement with inner gear 76, the inner gear 76 is also forced to rotate. Rotation of inner gear 76 and outer gear 66 causes pumping action from inlet 26 to outlet 28.

FIGS. 12-18 depict another pump identified at reference numeral 200. Pump 200 is also configured as an integrated electric auxiliary oil pump adapted to be coupled to a power transmission device such as transmission 14. Pump 200 may be externally mounted to transmission housing 12. Pump 200 includes a housing 202 with an inlet port 204 and an outlet port 206. Housing 202 defines a cavity 208 having a side wall 210. A recess 214 is defined by a substantially cylindrical wall 216. Threaded apertures 218 are circumferentially spaced apart from one another.

Figure 16:
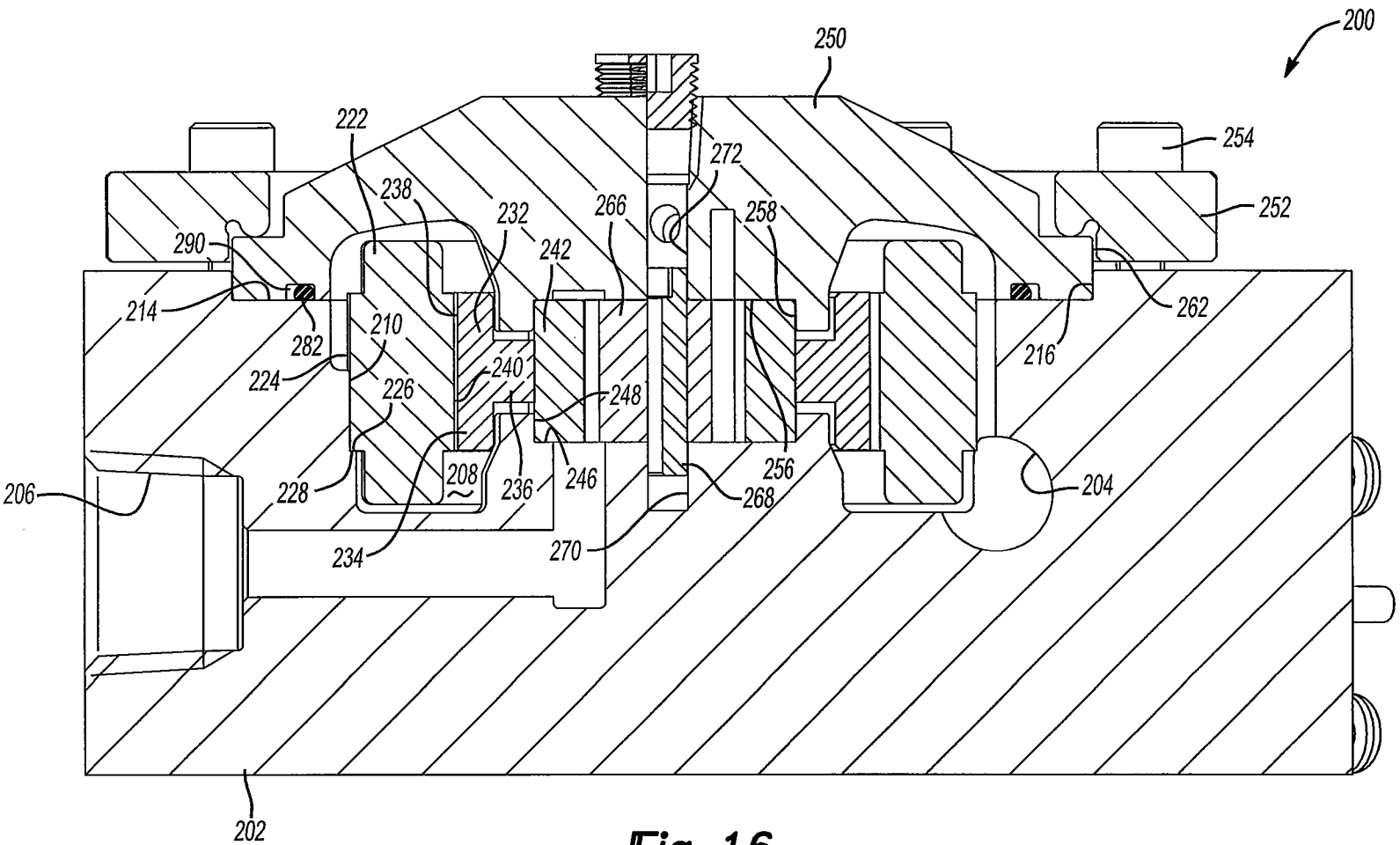
FIG. 16 is a cross-sectional view taken along line 16-16 shown in FIG. 12.
Figure 17:
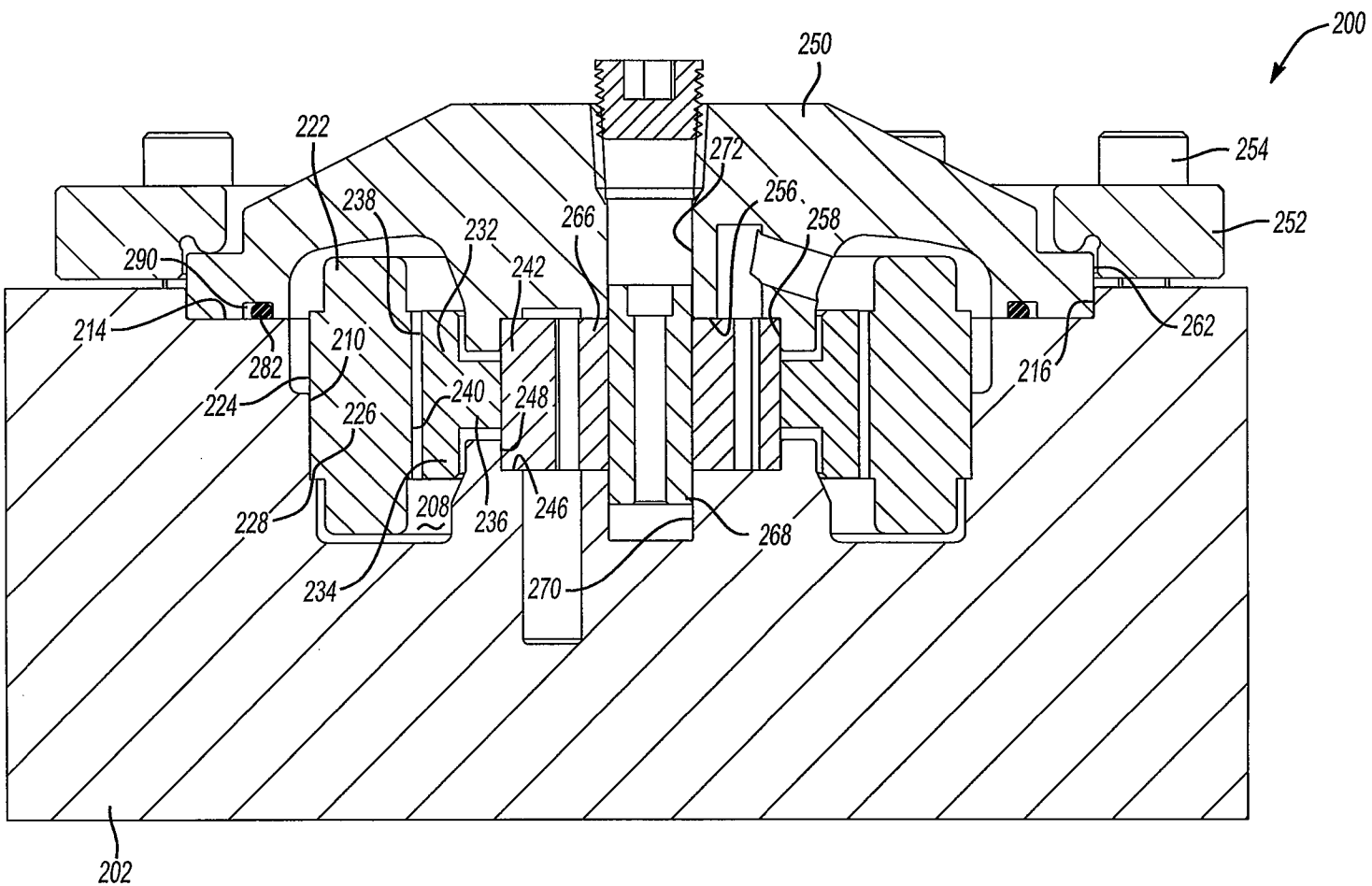
FIG. 17 is a sectional view taken along line 17-17 shown in FIG. 12.
Figure 18:
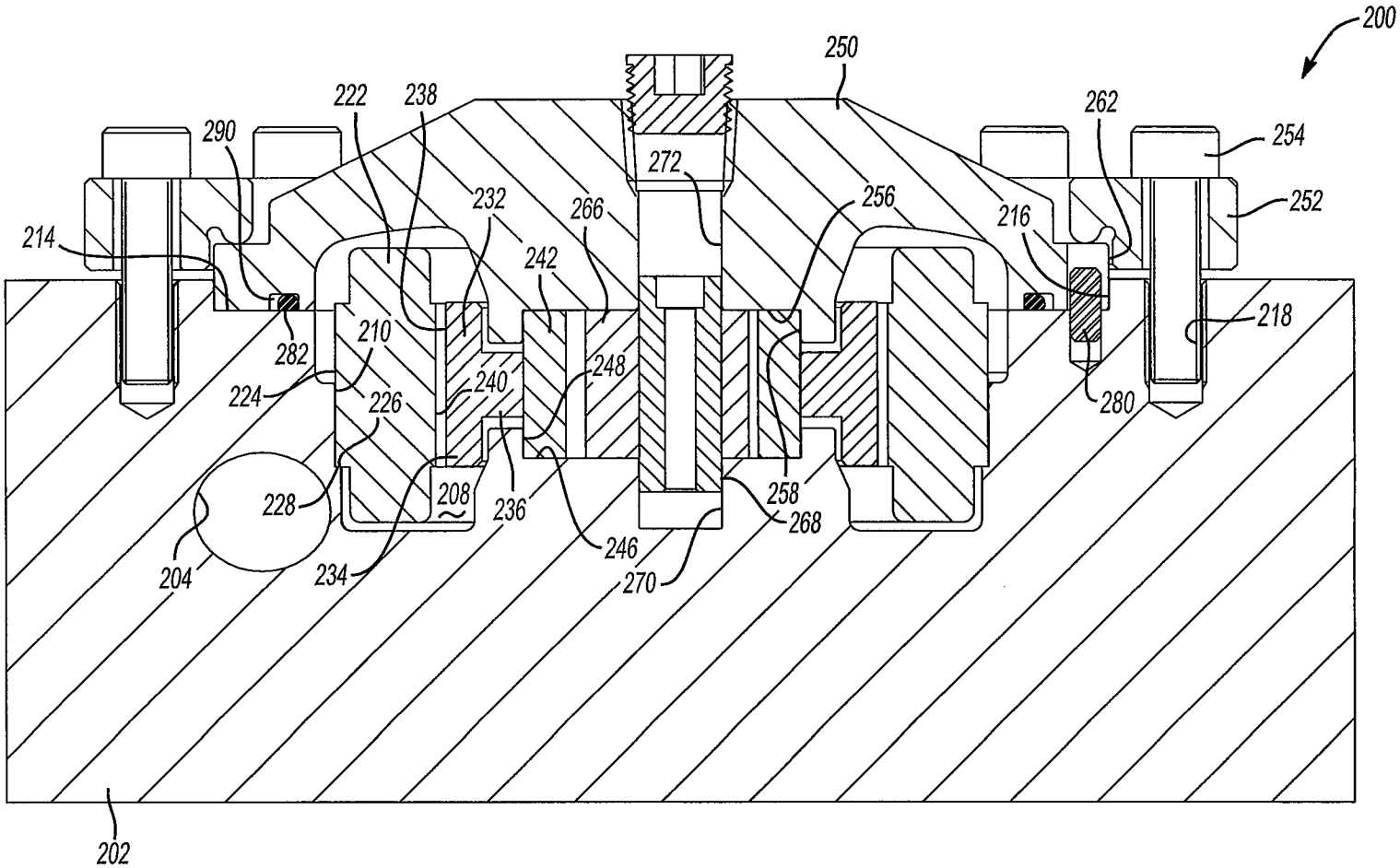
FIG. 18 is a sectional view taken along line 18-18 shown in FIG. 12.

As best shown in FIGS. 16-18, pump 200 includes a stator 222 positioned within cavity 208. Side wall 210 is sized to closely fit an outer surface 224 of stator 222 to restrict stator 222 from radial movement. A land 226 is formed on housing 202 to partially define cavity 208 and provide a seat for a surface 228 of stator 222 to restrict axial movement of the stator relative to housing 202.

A magnet ring 232 includes a substantially cylindrical portion 234 and a radially inwardly protruding portion 236. Magnet ring 232 includes a metallic backing ring portion and a plurality of magnets formed as one component. An outer substantially cylindrical surface 238 is spaced apart from an inner substantially cylindrical surface 240 of stator 222. An outer rotor 242 is fixed to magnet ring 232. A seat 246 and a substantially cylindrical wall 248 are sized to clear the outer dimensions of outer rotor 242 but be closely positioned to the outer rotor to maintain a desired radial and axial position of outer rotor 242.

A cover 250 is fixed to housing 202 by a clamp ring 252 and fasteners 254. Cover 250 also defines a substantially planar surface 256 and a substantially cylindrical surface 258 that maintain the position of outer rotor 242. The alignment of cylindrical surfaces 258 and 248 is achieved by closely sizing an outer cylindrical surface 262 of cover 250 with cylindrical wall 216. An inner rotor 266 drivingly mates with outer rotor in similar fashion to that previously described with reference to inner gear 76 and outer gear 66. Inner rotor 266 is fixed to a center shaft 268. Inner rotor 266 and center shaft 268 are configured to rotate as a singular unit relative to housing 202 and cover 250. A bore 270 formed in housing 202 and a bore 272 formed in cover 250 receive ends of center shaft 268 and define its axis of rotation. Face 256 and seat 246 limit axial translation of inner rotor 266.

FIG. 18 depicts a dowel 280 positioned to assure accurate alignment and indexing of cover 250 relative to housing 202. A seal 282 is positioned within a groove 290 formed in cover 250 and engages recess 214.

Figure 19:
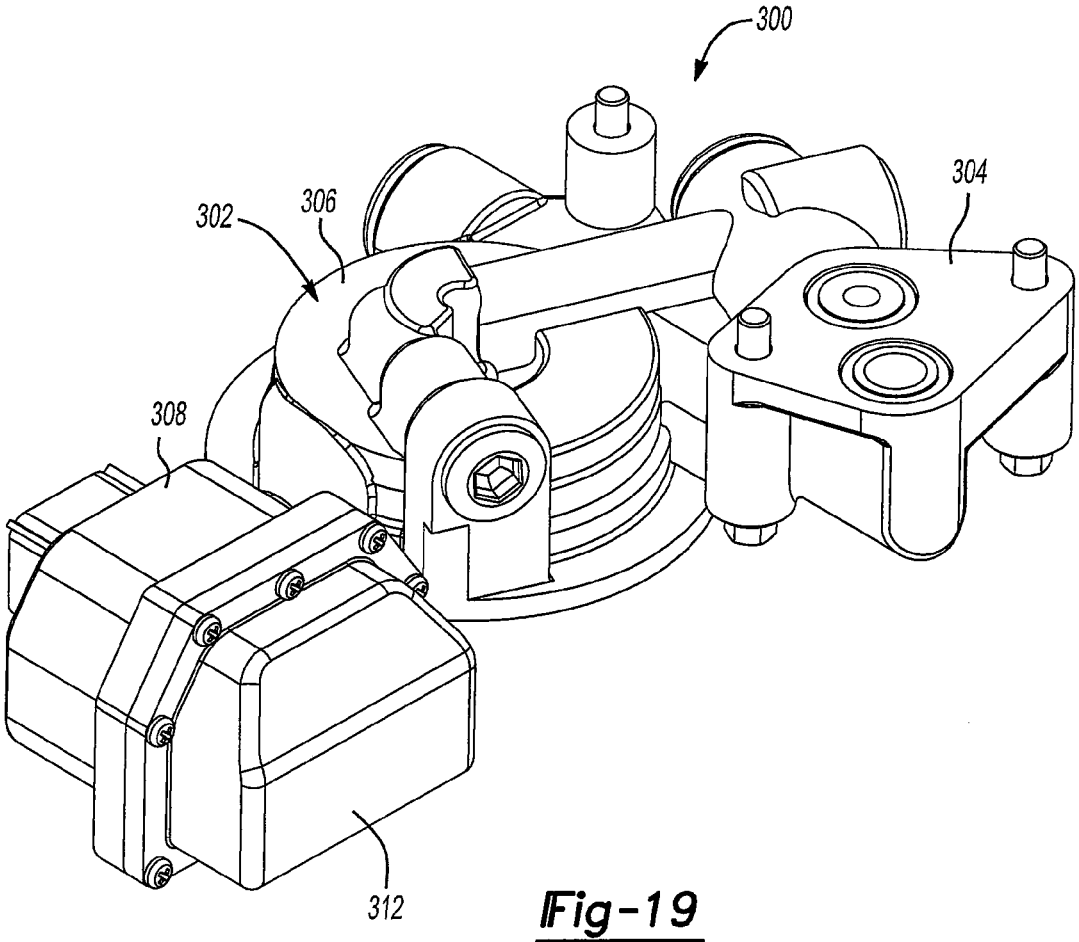
FIG. 19 is a perspective view of another electric auxiliary oil pump.
Figure 20:
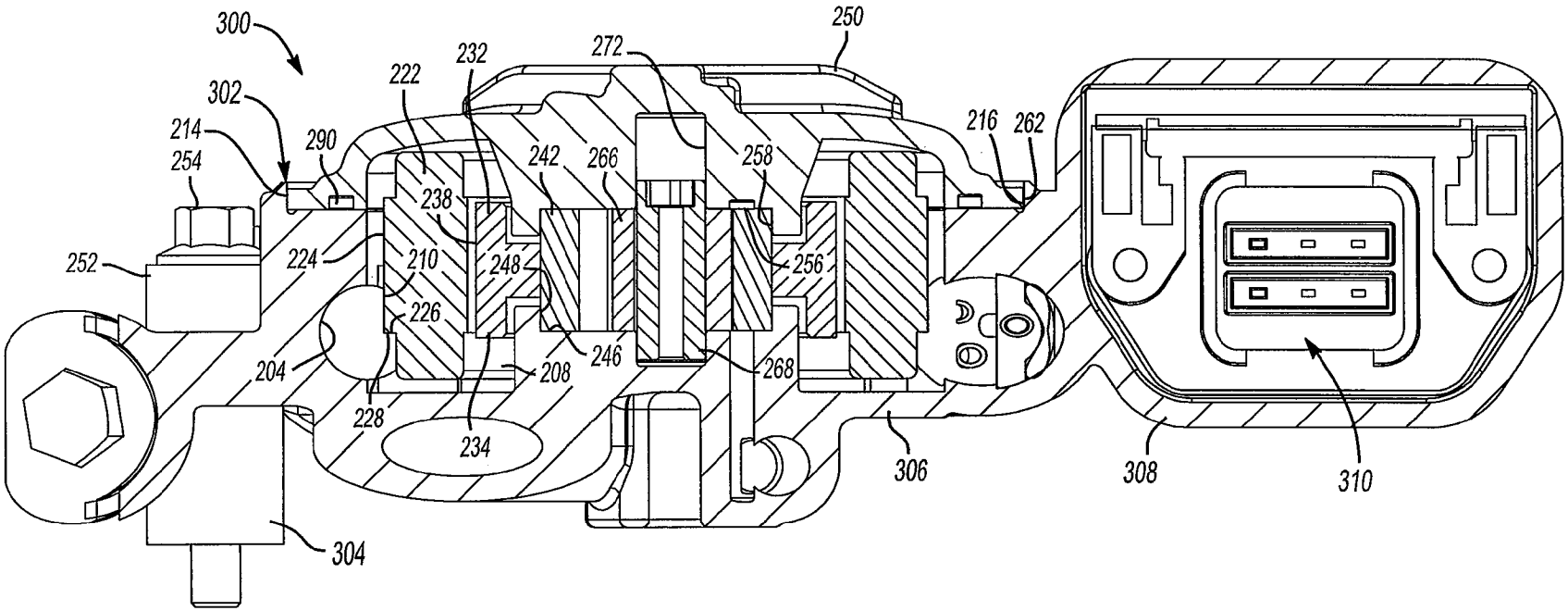
FIG. 20 is a sectional view of the oil pump depicted in FIG. 19.

FIGS. 19 and 20 relate to another integrated electric auxiliary oil pump identified at reference numeral 300. Pump 300 includes a monolithic housing 302 including a mounting portion 304, a pump and motor portion 306 and a controller portion 308. A pump and motor controller 310 is positioned within controller portion 308. A controller cover 312 sealingly engages controller portion 308 of housing 302. Controller 310 is positioned within a sealed environment free from contact with the fluid to be pumped.

Figure 21:
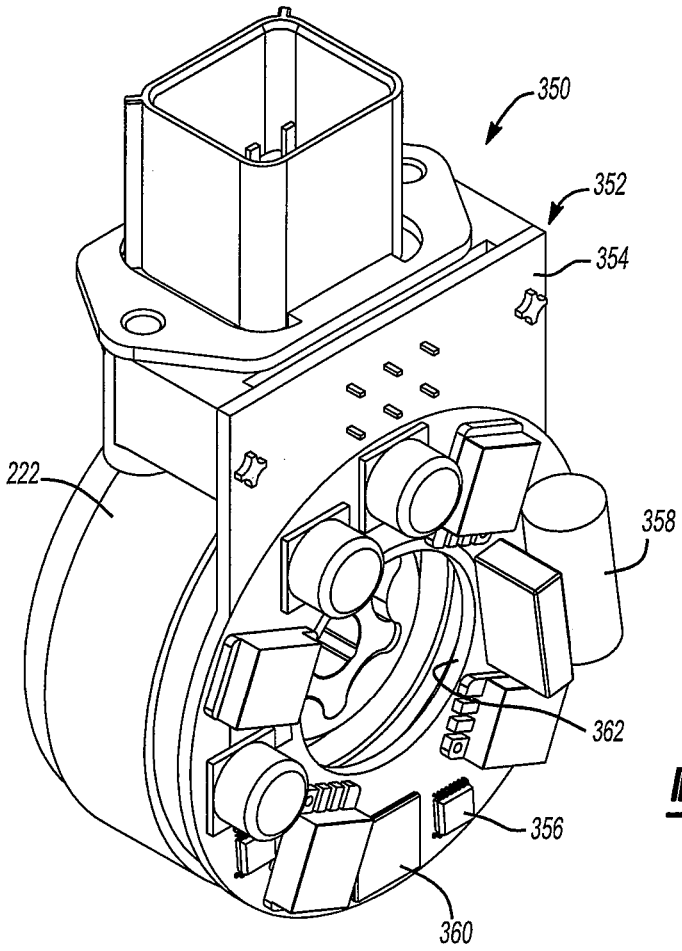
FIG. 21 is a partial perspective view of a pump having a ring shaped controller.
Figure 22:
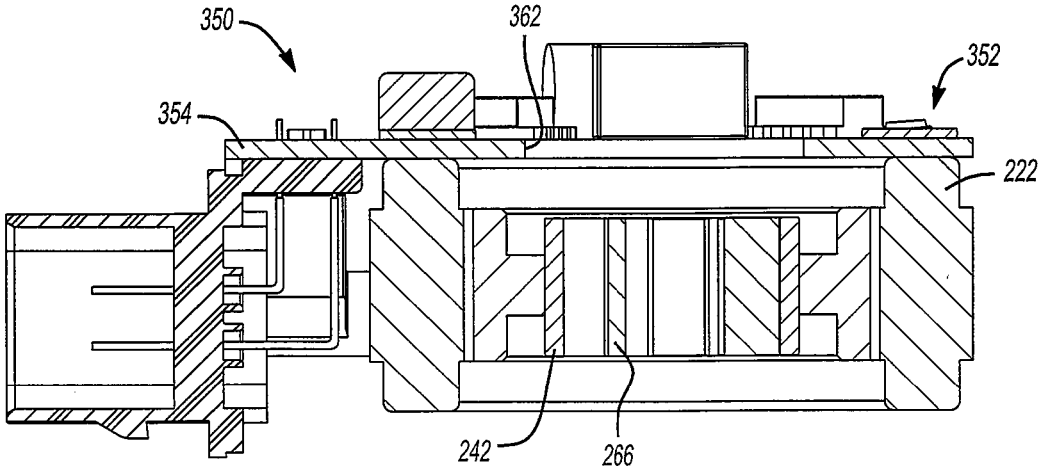
FIG. 22 is a sectional view of the pump depicted in FIG. 21.

FIGS. 21 and 22 depict a portion of an alternate pump identified at reference numeral 350. Pump 350 is substantially similar to pump 200 with the exception of a ring-shaped controller 352 being positioned adjacent stator 222. Controller 352 includes a board 354 positioned in engagement with stator 222. A number of electronic components including an integrated circuit 356, a capacitor 358 and a microprocessor 360 are fixed to board 354. Controller 352 is operable to control operation of pump 350. Board 354 and the components coupled thereto may be in communication with the fluid in which pump 350 is submersed. Based on the properties of the fluid to be pumped, controller 352 will function properly regardless of exposure to the fluid. A central aperture 362 extends through board 354. Central aperture 362 is sized and positioned to allow inner rotor 266 and outer rotor 242 to pass therethrough.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An externally mounted electric fluid pump for pumping fluid within a power transmission device, the pump comprising:

a housing adapted to be mounted to an external surface of the power transmission device;

a pump positioned within the housing and including an input member, wherein the pump includes a gerotor and the input member includes an outer gear of the gerotor;

an electric motor positioned within the housing to be inline axially to the pump, said electric motor driving the input member, wherein the electric motor includes a permanent magnet fixed to the input member;

a cover engaging the housing and being in biased engagement with a support plate positioned adjacent the outer gear; and a controller positioned within the housing to control the electric motor and vary the output of the pump.

2. The fluid pump of claim 1 wherein the permanent magnet and a stator circumscribe an inner gear and the outer gear of the pump.

3. The fluid pump of claim 1 wherein the housing includes a mounting face adapted to engage the external surface of the power transmission device, the pump further including an inlet and an outlet extending through the mounting face.

4. An externally mounted electric fluid pump for pumping fluid within a power transmission device, the pump comprising:

a housing adapted to be mounted to an external surface of the power transmission device;

a pump positioned within the housing and including an input member;

an electric motor positioned within the housing and driving the input member; and a controller positioned within the housing to control the electric motor and vary the output of the pump, wherein the controller is in fluid communication with the fluid to be pumped.

5. An externally mounted electric pump for pumping fluid within a power transmission device, the pump comprising:

a first housing member adapted to be mounted to an external surface of the power transmission device and including a first recess having a substantially planar first pump surface surrounded by a first wall;

a second housing member fixed to the first housing member including a second recess having a substantially planar second pump surface surrounded by a second wall as well as being spaced apart from and extending substantially parallel to the first pump surface;

a gerotor pump having an inner rotor and an outer rotor, each rotor having opposite faces positioned adjacent the first and second pump surfaces, the outer rotor being aligned on an axis of rotation by the first and second walls;

a rotor shaft engaging each of the first and second housing members and defining an inner rotor axis of rotation offset from the outer rotor axis of rotation;

an electric motor stator positioned within a pocket formed in one of the first and second housing members; and a plurality of permanent magnets fixed for rotation with the outer rotor, the magnets being positioned proximate the stator.

6. The fluid pump of claim 5 wherein the rotor shaft is fixed for rotation with the inner rotor.

7. The fluid pump of claim 6 wherein the stator engages a land and a side wall of one of the first and second housing members.

8. The fluid pump of claim 5 further including a magnet ring including a radially extending portion fixed to the outer rotor, wherein the magnets are fixed to the magnet ring.

9. The fluid pump of claim 8 wherein the magnet ring includes a cylindrically shaped portion surrounding the radially extending portion to define a T-shaped cross section.

10. The fluid pump of claim 5 further including a motor controller coupled to the stator.

11. The fluid pump of claim 10 wherein the motor controller includes a cylindrically shaped board having electronic components mounted thereon, the board having an aperture extending therethrough to provide a passageway for the inner and outer rotors to pass.

12. The fluid pump of claim 5 further including a controller positioned within the housing to control the electric motor and vary the output of the pump.

13. The fluid pump of claim 12 wherein the controller is in fluid communication with the fluid to be pumped.

14. The fluid pump of claim 12 wherein the housing includes a mounting portion, a pump and motor portion and a controller monolithically formed with each other, wherein the controller portion is in receipt of the controller and is sealed from the other portions.

* * * * *